United States Patent [19]

Berfield

[11] Patent Number: 4,799,285

[45] Date of Patent: Jan. 24, 1989

[54] OUTLET PORT BAFFLE FOR EXHAUST AIR

[75] Inventor: Robert C. Berfield, Jersey Shore, Pa.

[73] Assignee: Shop-Vac Corporation, Williamsport, Pa.

[21] Appl. No.: 114,079

[22] Filed: Oct. 27, 1987

[51] Int. Cl.[4] ..... A47L 5/00

[52] U.S. Cl. ..... 15/327 R; 98/122

[58] Field of Search ..... 15/327 R, 327 D, 353, 15/405; 98/40.2, 40.21, 122; 406/157

[56] References Cited

U.S. PATENT DOCUMENTS

| | | | |
|---|---|---|---|
| 1,432,187 | 10/1922 | Jenkins et al. | 98/122 |
| 2,793,912 | 5/1954 | Krohm . | |
| 3,081,877 | 8/1958 | Jakobs et al. . | |
| 3,497,141 | 2/1968 | Rydberg . | |
| 3,997,116 | 12/1976 | Moen . | |
| 4,114,231 | 9/1978 | Nauta | 15/353 |
| 4,284,241 | 8/1981 | Azalbert | 239/272 |
| 4,355,434 | 10/1982 | Gongwer | 15/327 R |
| 4,398,453 | 8/1983 | Wilkerson | 98/122 |

*Primary Examiner*—Timothy F. Simone
*Assistant Examiner*—Corinne M. Reinckens
*Attorney, Agent, or Firm*—Ostrolenk, Faber, Gerb & Soffen

[57] ABSTRACT

An outlet port baffle for an air or gas exhaust port comprises a cylindrical entrance section, a conical intermediate section terminating in an end wall. The conical intermediate section has two rows of apertures extending over an arcuate segment of that section and has radially projecting, circumferential ridges which are between and also define the apertures. Fluid enters the cylindrical section and flows to the conical section where it is redirected in a direction normal to its original flow and through the apertures. The outlet port baffle may be utilized to redirect the air exhaust from a vacuum cleaner, for example.

11 Claims, 1 Drawing Sheet

OUTLET PORT BAFFLE FOR EXHAUST AIR

BACKGROUND OF THE INVENTION

1. Field of the Invention

The present invention relates to an outlet port baffle, and, more particularly, to an exhaust air outlet port baffle, particularly for a vacuum cleaner.

2 Description of the Related Art

Many models of vacuum cleaners have an exhaust port into which a hose or tool can be inserted to utilize the air for blowing purposes. This port usually is aimed to direct the air either upwardly or horizontally away from the vacuum cleaner. However, when a hose or tool has not been inserted into the port, there is an undesirable blast of exhaust air straight out of the port.

Various attempts have been made to control the orientation of the blast of air from an exhaust port, such as utilizing an elbow fitting which redirects the air flow in a direction across, and particularly normal, to its original flow. Two-piece fittings, comprising an elbow fitting and a cap fitting placed at the outlet from the elbow, have also been used to provide additional baffling of the air from the exhaust port.

It is, of course, well known to provide nozzles for directing fluids exiting an orifice. U.S. Pat. No. 3,997,116 to Moen discloses a shower head nozzle having numerous ridges and apertures located in arcuate segments extending 360° around the body of the shower head.

U.S. Pat. No. 2,793,912 to Krohm discloses a nozzle assembly for applying windshield washer fluid to an automobile windshield. The assembly comprises an anchor piece for placement in the body of the automobile and a nozzle piece which is radially adjustable within the anchor piece.

U.S. Pat. No. 4,284,241 to Azalbert discloses a spray nozzle for distributing fluid. The nozzle is a cylindrical body with an end cap. Numerous longitudinal triangular apertures are provided in the nozzle.

U.S. Pat. No. 3,497,141 discloses a hose nozzle spray attachment for a fire hose. The attachment is a conical member having an end cap which baffles the water from a fire hose.

These attempts in the prior art to direct fluids from an exit orifice have resulted in unsightly fittings having limited ability for precisely redirecting the fluid from the exit orifice.

SUMMARY OF THE INVENTION

Accordingly, an object of the present invention is to provide an outlet port baffle which redirects gas or air in a direction across, and more particularly normal, to the original direction of air exiting from the outlet port.

Another object is to provide an outlet port baffle having the ability to redirect gas or air in a direction across or normal to its original direction and through an arcuate segment of the baffle.

Yet another object is to enable the direction of outflow from the port to be adjustable.

A further object of the present invention is to provide an outlet port baffle that is aesthetically pleasing.

These and other objects of the present invention are achieved with an air or gas outlet port baffle defined along one axis and which has three sections. The entrance section for connection with, e.g. insertion into, the outlet port is generally cylindrical. The intermediate section is conical. It has a series of radially projecting, circumferentially extending ridges which are adjacent to and define a series of apertures into the intermediate section. The apertures are preferably arranged in two axially extending rows of apertures which rows together extend over an arcuate segment of the intermediate section and preferably over a 180° arc segment. The outlet section is an end cap oriented across, and particularly normal, to the original direction of the air or gas flow, and which blocks passage through the end of the baffle and forces the air or gas through the apertures.

The outlet port baffle of the present invention is slidable and adjustable in the outlet orifice so that it may be rotated in its orientation to cause the air or gas outlet apertures to be directed in any direction around the axis of the baffle.

Other objects and features of the invention are seen from the following description and accompanying drawings.

DETAILED DESCRIPTION OF THE PREFERRED EMBODIMENT

Figure 1:
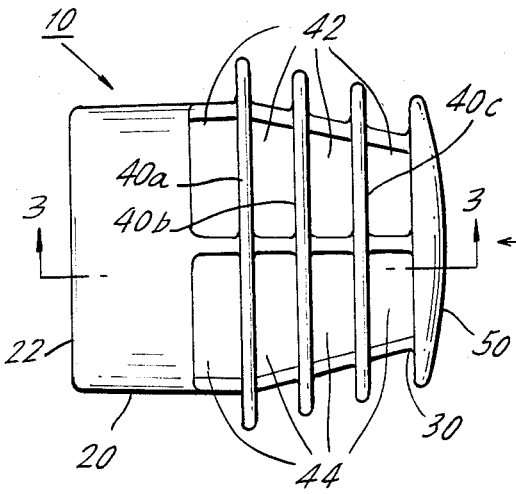
FIG. 1 shows a top view of the outlet port baffle of the present invention.

The outlet port baffle 10 of the present invention comprises an entrance section 20, an intermediate section 30 and an outlet end section 50. The outlet port baffle of the present invention may be formed of any suitable material, but is preferably of molded plastic.

Entrance section 20 comprises a cylindrical tubular portion having an entrance fitting 22. Fitting 22 is received into the output port or orifice of the exhaust port of a vacuum cleaner, for example, to receive the air or gas from the orifice.

Entrance section 20 is integral with and leads into air or gas redirecting, intermediate section 30. Intermediate section 30 is also tubular. It has a generally conical shape tapering narrower toward the outlet end section 50. The intermediate section 30 and possibly also the downstream end of the entrance section 20 together have two parallel, longitudinally extending rows of apertures 42 and 44, for directing the gas or air radially outward of the intermediate section 30. Each aperture is shorter in its dimension axially of the baffle, and arcuately or circumferentially of the baffle it is much wider. The rows of apertures are arranged laterally together to together define an arcuate segment shaped open region around the baffle, and to direct the outflow of gas or air over the arc. The drawings illustrate that the apertures permit air dispersal over a 180° arc. Any arcuate angle segment of the baffle section 30 may be occupied by the exit apertures, so long as the apertures direct flow generally toward one direction.

Circumferentially extending, radially projecting ridges **40*a*, 40*b*, and 40*c* project from the intermediate section 30. They separate adjacent apertures 42, 42 and 44, 44 and they assist in the redirection of the gas or air. The ridges are shown as oriented to direct the air or gas radially outward. But, they may be otherwise oriented to angle the air flow obliquely with respect to the axis of the section 30**.

Figure 2:
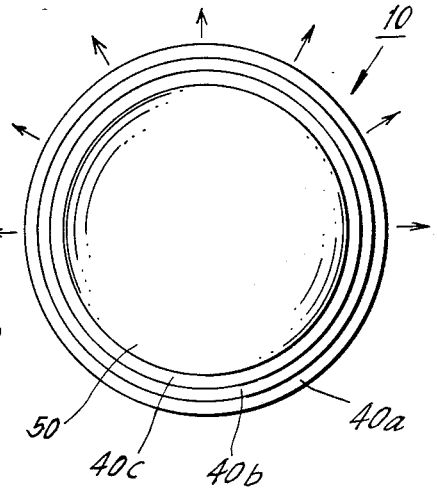
FIG. 2 shows an end view of the baffle of the present invention.
Figure 3:
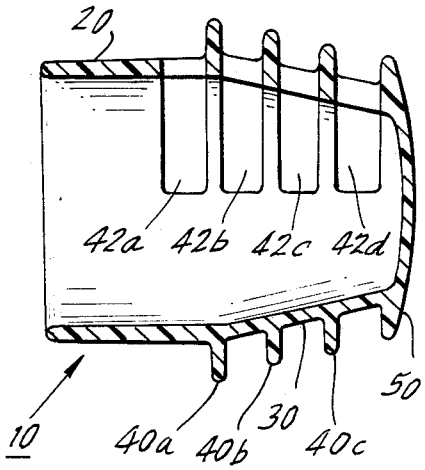
FIG. 3 shows a cross section view along lines A—A of FIG. 1.

The end section 50 is integral with the intermediate section 30. End section 50 comprises an end cap to block the flow of air or gas and thereby to redirect the flow from its original direction, illustrated by the arrow in FIG. 1, to flow out apertures 42 and 44 over an arcuate segment and normal to the original flow, as illustrated in FIG. 2.

In operation, fitting 22 of the outlet port baffle 10 is placed in the air or gas exhaust or outlet orifice of an apparatus. Air or gas flowing from the apparatus enters entrance section 20 and passes through intermediate section 30 where it is redirected by end section 50 through apertures 42 and 44.

Figure 4:
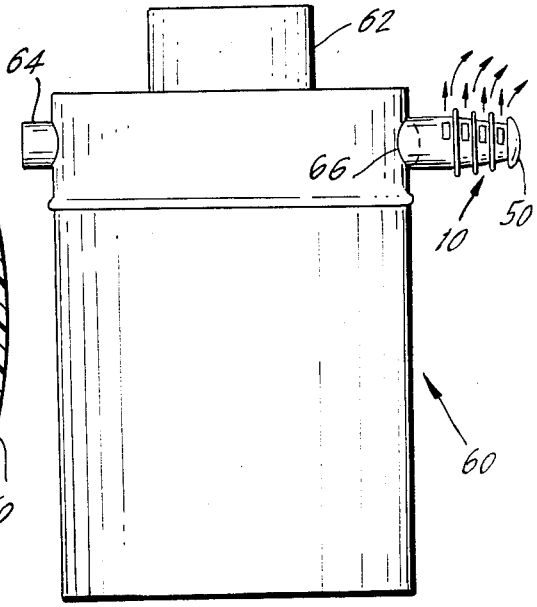
FIG. 4 shows the present invention in use with a vacuum cleaner apparatus.

In a preferred embodiment in FIG. 4, the outlet port baffle 10 is used to redirect the exhaust airblast exiting a vacuum cleaner 60. Vacuum cleaner 60 is a standard canister type vacuum cleaner having air moving fan motor housing 62 and suction inlet nozzle connector 64. Air flows through the collecting tank beneath housing 62 and then out exhaust outlet port 66. The entrance section 20 of outlet port baffle 10 is placed in port 66. Exhaust air is redirected through apertures 42 and 44. The outlet port baffle is slidably adjustable angularly by rotation around its axis in air outlet port 66, so that the user may direct the exiting redirected air in any direction, that is over any segment of a 360° arc.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. An outlet port baffle for redirecting air or gas exiting from an outlet port comprising:

a tubular entrance section for being connected with an outlet port and for receiving air or gas flowing through the outlet port and for conducting air therethrough;

a tubular intermediate section communicating with and forming an extension from the entrance section for conducting air or gas therethrough, a plurality of apertures through the intermediate section arrayed over an arc extending only partially around the intermediate section, and all of the apertures being oriented and together covering an arc that is of a length that air or gas flowing through the apertures will exit in the same general direction over an arcuate pathway which is across the path of the air or gas that has passed into the entrance section and through the intermediate section; the apertures are arranged in a plurality of rows of the apertures, with each of the rows extending along the length of the intermediate section and the rows together defining the arcuate exit pathway for the fluid; and an end section beyond the intermediate section for blocking passage of air or gas out the end of the intermediate section, for redirecting all of the air or gas out of the apertures of the intermediate section over the arcuate exit defined by the apertures;

the baffle being angularly movable in the outlet port to direct the air or gas from the apertures in a selected direction.

2. The outlet port baffle of claim 1, further comprising the intermediate section having a plurality of radially outwardly projecting ridges projecting radially outwardly from the intermediate section, and the apertures being defined by and between neighboring ridges.

3. The outlet port baffle of claim 2, wherein the ridges extend circumferentially around the intermediate section.

4. The outlet port baffle of claim 3, wherein the apertures and the ridges are shaped and oriented and positioned to redirect air or gas in a direction generally normal to the direction of flow through the entrance section.

5. The outlet port baffle of claim 1, wherein there are at least two apertures in each row of apertures.

6. The outlet port baffle of claim 2, wherein the intermediate portion of the baffle is conically shaped, tapering generally narrower toward the end section.

7. The outlet port baffle of claim 6, wherein the entrance section is generally cylindrical in shape.

8. The outlet port baffle of claim 7, wherein the baffle sections have a common axis generally on the path of air entering the entrance section.

9. The outlet port baffle of claim 3, wherein the baffle sections have a common axis generally on the path of air entering the entrance section.

10. The outlet port baffle of claim I, wherein the entrance section is generally cylindrical in shape.

11. In combination, a vacuum cleaner having an air inlet, an air outlet port, and collection means between the air inlet and air outlet port, and means for moving air from the inlet port through the collection means and out the outlet port, and an air outlet port baffle according to claim 2, wherein the entrance section of the outlet port baffle is removably connectable in and angularly rotatable in the outlet port of the vacuum cleaner and the outlet port and entrance section of the outlet port baffle are respectively so shaped as to enable the angular position of the outlet port baffle with respect to the vacuum cleaner to be adjusted for placing the apertures in any selected angular position around the axis of the outlet port baffle.

* * * * *